United States Patent [19]

Bechthold

[11] 4,407,362

[45] Oct. 4, 1983

[54] FLOW CONTROL APPARATUS FOR WELLS

[75] Inventor: Howard D. Bechthold, Plano, Tex.

[73] Assignee: Otis Engineering Corporation, Dallas, Tex.

[21] Appl. No.: 272,363

[22] Filed: Jun. 10, 1981

[51] Int. Cl.[3] ..... E21B 23/00

[52] U.S. Cl. ..... 166/117.5; 166/332; 175/318

[58] Field of Search ..... 166/117.5, 332, 333, 166/334; 175/317, 318; 251/325; 137/614.17

[56] References Cited

U.S. PATENT DOCUMENTS 3,827,490 8/1974 Moore, Jr. et al. ..... 166/117.5

4,066,128 1/1978 Davis et al. ..... 166/117.5 X

*Primary Examiner*—Ernest R. Purser

*Assistant Examiner*—Thuy M. Bui

*Attorney, Agent, or Firm*—Albert W. Carroll

[57] ABSTRACT

A side pocket mandrel for use in gas lift wells and having a sleeve valve in its side pocket receptacle for closing the receptacle's lateral ports when no flow control device is disposed therein. The sleeve valve is latched in its port-closing position but is readily displaced to its open position when a gas lift valve or other flow control device is installed in the receptacle. When the flow control device is withdrawn from the receptacle, the sleeve valve is returned to its closed position, there being provision for automatically coupling the sleeve valve and flow control device together in end-to-end relation in response to the flow control device being installed in the receptacle and for automatically uncoupling them in response to removal of the flow control device from the receptacle. The seals carried by the flow control device seal in the same bore in which the seals of the sleeve valve engage and are, therefore, equal in diameter. Thus, full size, standard flow control devices are accommodated by this side pocket mandrel.

18 Claims, 12 Drawing Figures

FLOW CONTROL APPARATUS FOR WELLS

BACKGROUND OF THE INVENTION

1. Field of the Invention

This invention relates to well flow control apparatus and more particularly to side pocket mandrels and flow control devices used therein for controlling wells which are produced by a type of secondary recovery commonly known in the industry as "gas lift."

2. Description of the Prior Art

Side pocket mandrels have been used in practicing gas lift techniques for recovery of oil from wells for many years. These mandrels are connectable in a well tubing string to become a part thereof. Typically, they have a main bore or flow passage running their entire length and are provided with an offset belly in which is located a receptacle having a bore extending alongside the main bore. The receptacle bore is adapted to receive a flow control device such as, for instance, a gas lift valve, a check valve, a dummy valve, or the like. One or more ports in the wall of the receptacle provide fluid communication between the interior of the receptacle and the region exterior of the well tubing. The side pocket mandrels are scientifically spaced at appropriate depths in the well at which it is desired to have flow take place between the tubing and the annulus exterior thereof. A flow control device normally occupies each of the side pocket receptacles in a gas lift well, and proper adjustment of such devices results in lift gas, which is injected into the tubing-casing annulus at the surface, being admitted into the tubing at the proper depth to aerate the oil rising therein and aid in lifting it to the surface in the most efficient manner. When no flow control device is present in the receptacle of a side pocket mandrel in a well, the annulus and tubing communicate freely, that is, if the side pocket mandrel is of the standard type. A typical side pocket mandrel is illustrated and described in U.S. Pat. No. 3,827,490 issued Aug. 6, 1974 to Howard H. Moore and Harold E. McGowen, Jr. Illustrated and described in U.S. Pat. No. 4,066,128, which issued Jan. 3, 1978 to Jerry B. Davis and Guy W. Gant, is an improved side pocket mandrel and flow control device, the side pocket receptacle of which is provided with a sliding sleeve valve controlling the receptacle's lateral ports. The sliding sleeve valve is moved to open position when the flow control is installed, and the sleeve valve is returned to and left latched in closed position when the flow control device is removed. Thus, when no flow control device is present, communication between annulus and tubing is prevented.

The structure of the device of U.S. Pat. No. 4,066,128 is such that the external seals carried on the flow control device seal in the bore of the sleeve valve which in turn seals in the receptacle bore device, making the flow control device, of necessity, rather small in diameter and having a limited capacity flow passage therethrough for the conduction of lift gas. The seals carried on the flow control device are appreciably smaller in diameter than the seals carried by the sliding sleeve valve. The present invention overcomes these shortcomings by providing a side pocket mandrel having a sliding sleeve valve and accepting a flow control device having seals the same size as those on the sliding sleeve valve and sealing in the receptacle bore just as do the seals on the sliding sleeve valve. The flow control device, thus, can be a standard size and have a standard flow passage through it.

SUMMARY OF THE INVENTION

The present invention is directed to side pocket mandrels connectable into a well tubing and having a main bore extending therethrough, a belly offset laterally from the main bore, a receptacle having a bore extending alongside the main bore, a lateral port in the receptacle wall communicating the interior of the receptacle with the exterior of the mandrel, and a sleeve valve slidably disposed in the receptacle bore to close or cover the lateral port when no flow control device occupies the receptacle, but which will be moved to open position upon installation of a flow control device in the receptacle, there being coengageable means on said sliding sleeve valve and in said receptacle to latch the sleeve valve in closed position and coengageable means on the sleeve valve and on the flow control device to lock the two together as the flow control device is installed and the sleeve valve is displaced from closed position and being releasable to free the flow control device from the sleeve valve when the sleeve valve is returned to closed position upon removal of the flow control device from the receptacle, the seals carried by the sliding sleeve valve and by the flow control device being of equal diameter.

It is, therefore, one object of this invention to provide a side pocket mandrel having a sliding sleeve valve disposed in the side pocket receptacle thereof to close the lateral port when the receptacle bore is unoccupied by a flow control device.

Another object is to provide such a device in which the sleeve valve is latched in closed position in the receptacle bore.

Another object is to provide such a device in which the sleeve valve is movable to open position as the result of a flow control device being installed in the receptacle bore.

Another object is to provide a device of the character described having seals on the sleeve valve for sealing between the sleeve valve and the wall of the receptacle bore, such sleeve valve seals being of a diameter equal to that of the seals carried on the flow control device.

Another object of this invention is to provide flow control apparatus of the character described having lock members on the sleeve valve and on the flow control device which automatically engage to lock the two together in end-to-end relation when the flow control device moves the sleeve valve from its closed position and which will cause the sleeve valve to be returned to its closed position when the flow control device is removed from the side pocket receptacle, the lock members being disengageable automatically to release the flow control device from the sliding sleeve valve when the sliding sleeve valve is returned to its closed position as the flow control device is withdrawn from the receptacle.

Another object is to provide such a device in which the sleeve valve is positively locked in closed position against movement in either longitudinal direction but is readily unlockable for displacement to open position by an axial force applied thereto during installation of a proper flow control device.

Other objects and advantages will become apparent from reading the description of the invention which follows and from studying the accompanying drawing, wherein:

FIG. 1 is a fragmentary schematical view of a gas lift well showing the tubing thereof equipped with a plurality of side pocket mandrels of this invention;

FIGS. 2A and 2B, taken together, constitute a longitudinal sectional view showing a side pocket mandrel of this invention with a flow control valve installed in its side pocket receptacle;

FIGS. 3A and 3B, taken together, constitute a fragmentary, magnified, longitudinal sectional view of the flow control device and receptacle of FIGS. 2A and 2B showing some parts thereof in elevation;

Figure 3A:
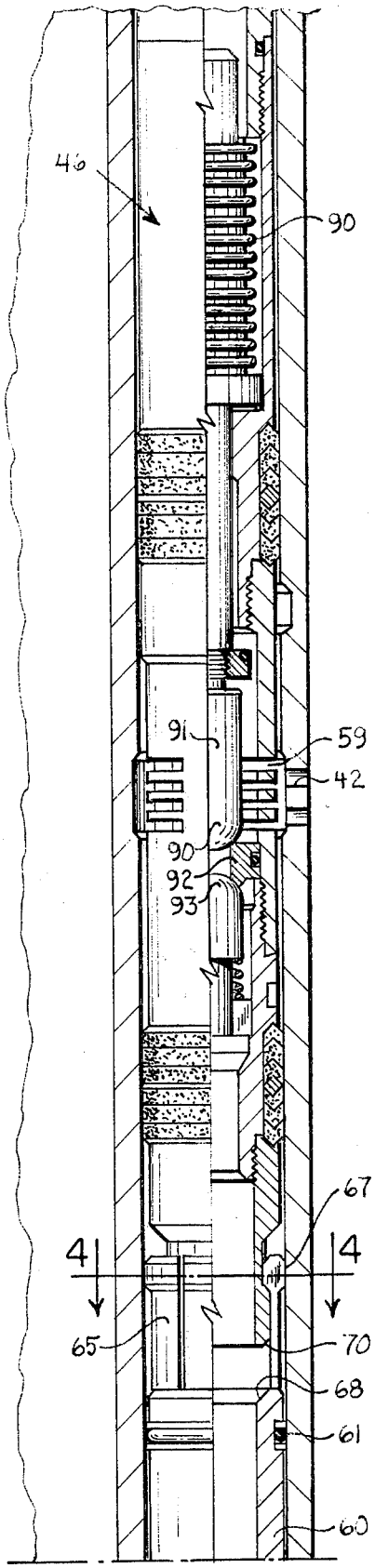
Figure 3B:
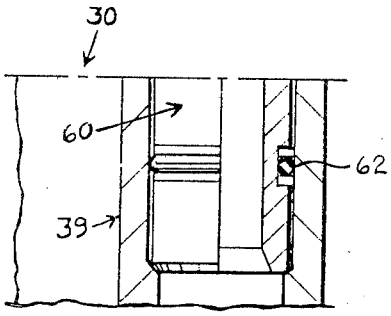
Figure 9A:
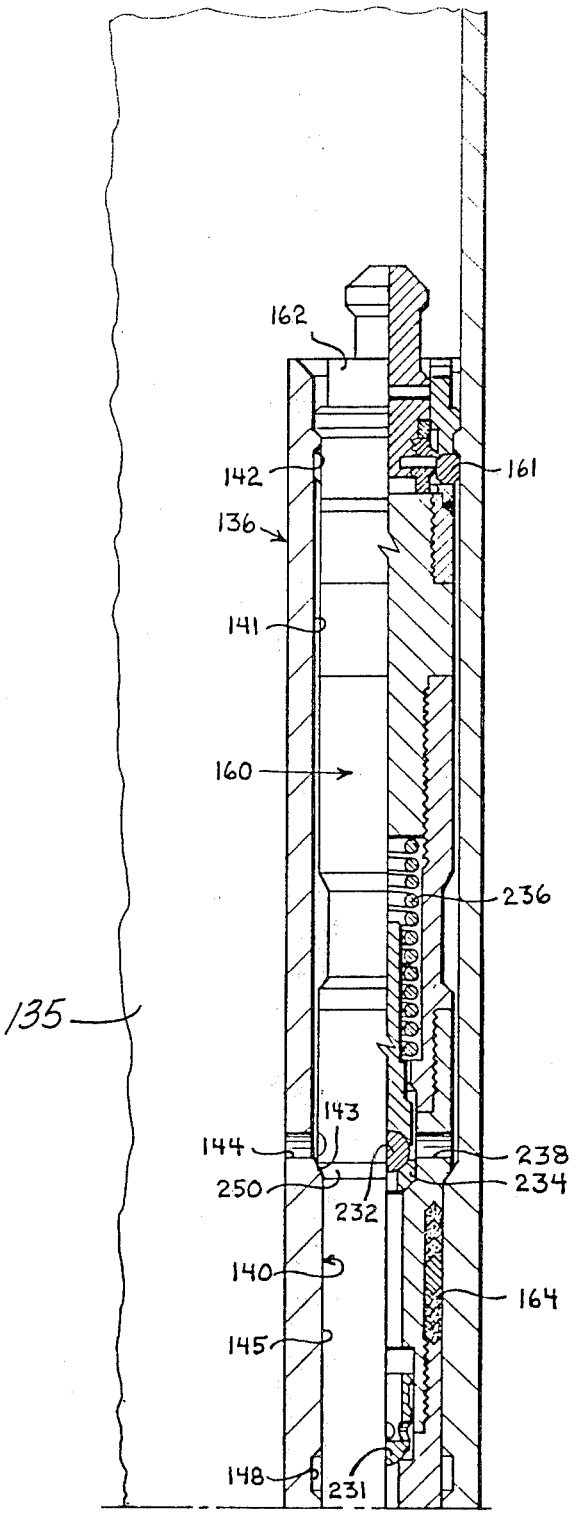
Figure 9B:
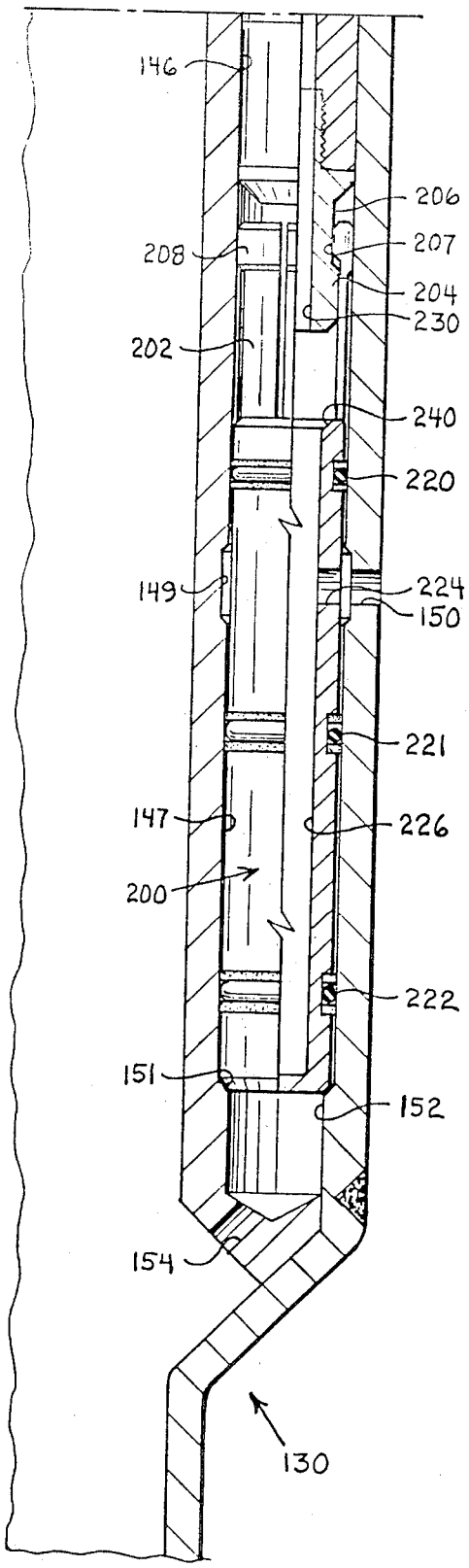

FIGS. 9A and 9B, taken together, constitute a view similar to FIGS. 3A and 3B but showing a modified form of sleeve valve disposed in the side pocket receptacle of the side pocket mandrel of this invention.

DESCRIPTION OF THE PREFERRED EMBODIMENTS

Figure 1:
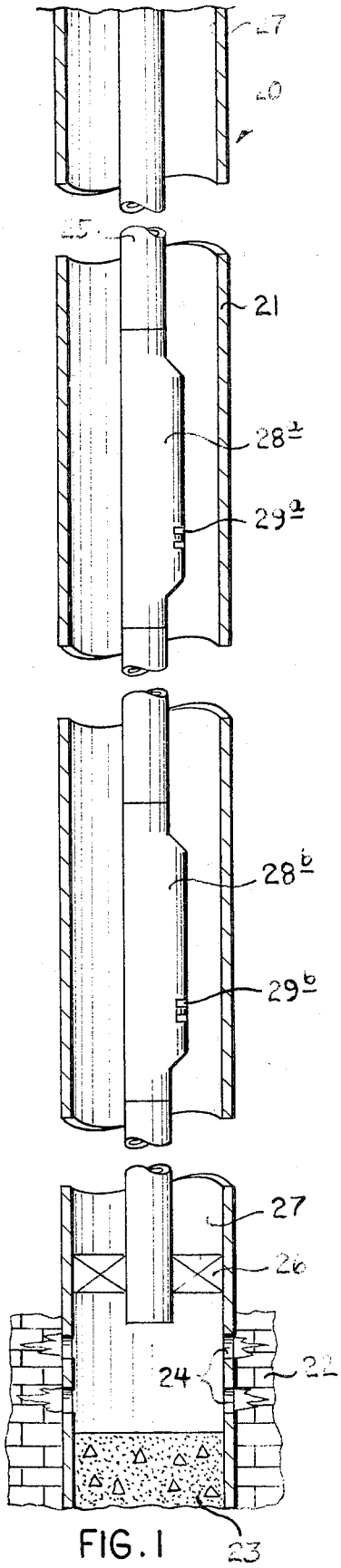

Referring to FIG. 1, it will be seen that a well installation 20 includes a string of casing 21 passing through a producing earth formation 22 and has its lower end plugged at 23 with cement. The casing is perforated as at 24 to provide for entry of well fluids into the casing 21 from the formation 22. A string of tubing 25 is disposed inside the well casing 21 in the usual manner, having a packer 26 which anchors the tubing in the casing and seals the tubing-casing annulus 27 just above the formation 22. The tubing includes side pocket mandrels 28*a* and 28*b* having lateral ports or openings 29*a* and 29*b*, respectively. Well products flow from the formation 22 through perforations 24 into the casing 21 and from there and into the tubing string 25. The natural bottom hole pressure (rock pressure) of the formation is insufficient to force the well products to the surface and through the surface equipment. The well products will, however, rise to a level well above the side pocket mandrels 28*a*, 28*b*. (Gas lift wells are often equipped with 5–8 side pocket mandrels, and it is not uncommon to have 9–10 in a well, although well 20 is shown to have but two.) The side pocket mandrels each house a flow control device (not shown) in its offset side pocket receptacle to control the entry of lift gas thereinto from the annulus through lateral ports 29*a* or 29*b*. The side pocket mandrels are located in the well and spaced apart scientifically according to good gas lift practices, and most of the lift gas at any one time usually passes through only one of the mandrels, the other mandrels coming into play automatically as needed, as when unloading the well and as a result of the working fluid level gradually being depressed as the natural rock pressure diminishes due to withdrawal of well products from the formation. The lift gas is injected into the annulus 27 at the surface and flows downwardly therethrough to the side pocket mandrels.

When no flow control devices are present in the side pocket receptacles, flow cannot take place through the lateral ports 29*a* or 29*b* because these ports are closed by sleeve valves (not shown), but when gas lift valves or flow control devices (not shown) are installed in the receptacles, these sleeve valves are displaced to a position in which they uncover or open the ports. When the gas lift valves or flow control devices are fully installed in the receptacles, they cover the lateral ports and will admit or prevent flow therethrough according to predetermined conditions, all in a manner to be described herein below.

Figure 2A:
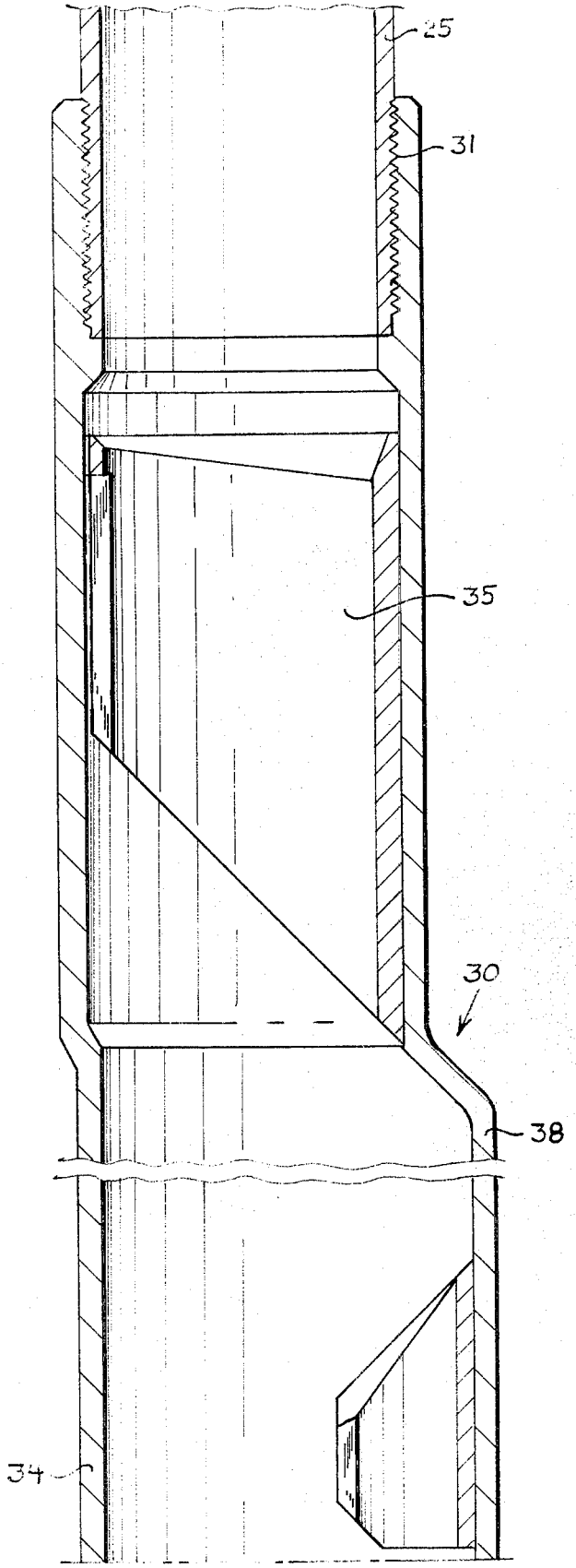
Figure 2B:
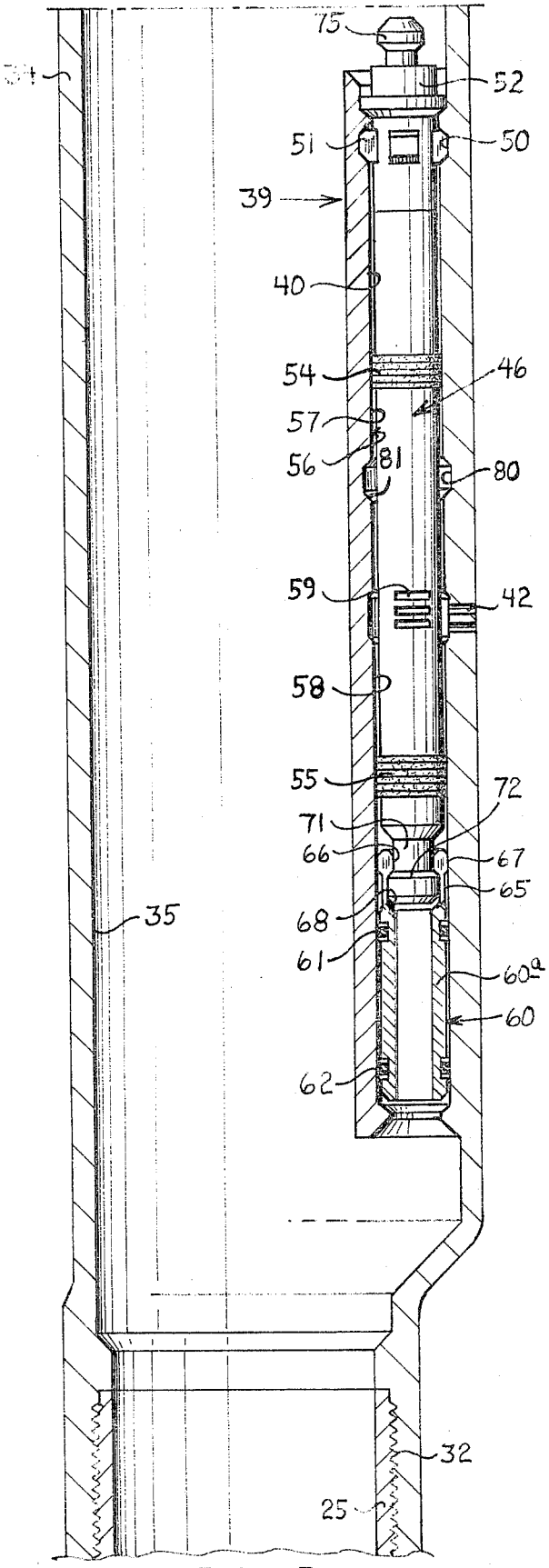

Referring now to FIGS. 2A and 2B, it will be seen that a side pocket mandrel 30 which may be like mandrel 28*a* or 28*b* is shown to be connected at its upper and lower ends as at 31 and 32, respectively, to a tubing string such as tubing 25. Mandrel 30 has a body 34 having a full open main bore 35 extending therethrough from end to end and is in axial alignment with the bore of the tubing.

Mandrel 30 has a belly 38 offset to one side of its main bore 35, and a side pocket receptacle 39 is located in the offset belly and has a receptacle bore 40 extending therein or therethrough alongside the main bore 35 and has at least one lateral port 42 communicating the receptacle bore 49 with the region exterior of the side pocket mandrel 30.

The receptacle bore 40 is adapted to receive flow control devices such as the gas lift valve 46 shown occupying the same or other flow control devices such as blanking devices, check valves, circulation control valves, chemical injection valves, or the like. Such devices are normally equipped with lock devices and seal rings. Receptacle bore 40, accordingly, has a lock recess 50 near its upper end to be engaged by locking lugs 51 of lock device 52, or the like, to anchor the flow control device, such as gas lift valve 46, in the receptacle bore with its seal ring sets 54 and 55 sealingly engaging seal surfaces 57 and 58 of the inner wall 56 of the receptacle bore above and below the lateral port 42, as shown. Lift gas entering the receptacle bore from the annulus through lateral ports 42 is directed to the inlet ports 59 of the gas lift valve since the gas cannot move past the packing sets 54 and 55 which seal the receptacle bore above and below the lateral ports 42.

Figure 4:
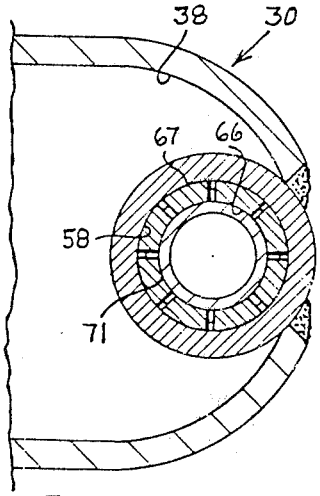
FIG. 4 is a cross-sectional view taken along line 4—4 of FIG. 3A.

Sleeve valve means in the form of sleeve valve 60 occupies the receptacle bore below the gas lift valve 46. The sleeve valve is generally tubular, imperforate, and has spaced seal rings such as o-rings 61 and 62 which are disposed above and below lateral ports 42 when the sleeve valve is in closed position, as when no flow control device is present in the receptacle bore. However, as shown in FIG. 2B, the entire sleeve valve is disposed below the ports 42. Collet fingers 65 having internal bosses 66 and external bosses 67 thereon are provided on sleeve valve 60 and extend upwardly from its upper end. Within the base of the collet fingers 65, an upwardly facing shoulder 68 is provided. A corresponding downwardly facing shoulder 70 is provided at the extreme lower end of gas lift valve 46 and, spaced a short distance thereabove, is an external annular recess 71 providing an upwardly facing shoulder 72. As shown in FIGS. 2B and 4, the collet fingers surround the lower end port of the gas lift valve, and their inner bosses 66 are engaged in the annular recess 71 of the gas lift valve while the fingers are confined against outward movement due to the outer bosses 67 of the collet fingers being in contact with the confining inner wall 58 of the receptacle bore. Thus, the sleeve valve is coupled to the gas lift valve. Obviously, when the gas lift valve 46 is unlocked, as by an upward force applied to its fishing neck 75 by means of a suitable tool string, and lifted, its upwardly facing shoulder 72 will engage the inner bosses 66 of the collet fingers, and further lifting of the gas lift valve will lift the sleeve valve in the receptacle bore.

Figure 5:
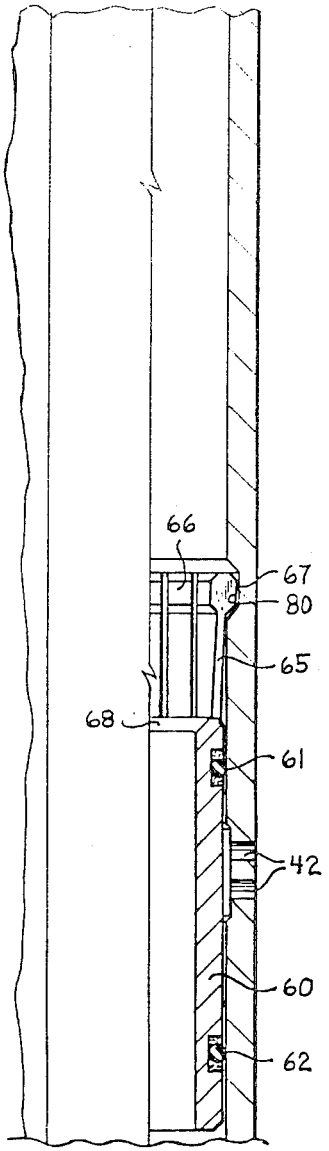
FIG. 5 is a fragmentary view similar to FIGS. 3A and 3B but showing the side pocket mandrel of FIGS. 3A and 3B without the flow control device in place and showing the sleeve valve in closed position.

When the sleeve valve is lifted sufficiently to locate the outer bosses 67 of its collet fingers opposite internal annular latch recess 80 formed in the wall of the receptacle bore, the collet fingers, which are inherently sprung outwardly, will move outwardly, and their outer bosses 67 will engage in recess 80 to latch the sleeve valve in that position. At the same time, their inner bosses 66 will disengage recess 71 of the gas lift valve and will clear upwardly facing shoulder 72 which forms the lower wall of recess 71, and the gas lift valve can no longer lift the sleeve valve. Thus, the sleeve valve is left with its collet finger outer bosses engaged in internal recess 80 of the receptacle bore to latch or detain the sleeve valve against unwanted movement since, in this position of the sleeve valve, its upper and lower seal rings 61 and 62 sealingly engage the seal surfaces 57 and 58, respectively, above and below lateral ports 42. Thus, the lateral ports 42 are closed by virtue of the imperforate portion 60*a* of the sleeve valve with the seal rings 61 and 62 bridging across the ports 42, precluding flow therethrough, as is clearly seen in FIG. 5.

When the gas lift valve 46, or another suitable flow control device, is installed in the receptacle bore 40 of the side pocket mandrel 30, its lower end portion will move down between the collet fingers 65 until the shoulder 70 at its extreme lower end engages the corresponding upwardly facing shoulder 68 in the sleeve valve, and further downward movement of the gas lift valve 46 pushes the sleeve valve down ahead of it. As the sleeve valve moves down, the outer bosses of the collet fingers contact the chamfer 81 of recess 80 and are cammed inwardly. As the collet fingers are thus forced inward, their inner bosses engage external recess 71 of the gas lift valve to couple the gas lift valve to the sleeve valve, and as the outer bosses enter the confining bore 58 in the receptacle, this couple is made secure. When the gas lift valve is fully seated, it is locked by actuating lock 52 in a well-known manner and left in this position for the gas lifting operation.

During the gas lift operation, lift gas enters the receptacle bore through lateral ports 42 (see FIG. 3) and enters the gas lift valve 46 disposed therein as shown through inlet ports 59. This lift gas acts at all times on the bellows 90 tending to compress the same and lift the tip 90 of valve 91 off seat 92 to permit the lift gas to flow therethrough, then past check valve 93, out the lower end of the gas lift valve, through sleeve valve 60, and out the lower end of receptacle bore 40. Thus it emerges into the main bore 35 of mandrel 30 and flows into the well tubing 25 connected thereto. The lift gas thus permitted to enter the tubing through the gas lift valve 46 aerates the well products in the tubing and aids in lifting them to the surface.

So long as the pressure of the lift gas is sufficient to overcome the bellows 90, the valve 91 will be held off seat 92, and lift gas will flow from the annulus into the tubing. When this pressure subsides sufficiently, the bellows will expand and move the valve to closed on-seat position, shown, and prevent further flow. Thus, by controlling the annulus pressure, the gas lift valve can be controlled, and likewise, the injection of gas into the tubing.

Thus, it has been shown that the side pocket mandrel 30 has a receptacle bore with lateral ports through the wall thereof communicating the receptacle bore with the exterior of the mandrel as is well known in the art and that mandrel 30 is further provided with a sleeve valve in the receptacle bore which seals the lateral ports against flow therethrough when no flow control device is present in the receptacle bore. This, of course, is taught in U.S. Pat. No. 4,066,128 mentioned above. It will be noted that the mandrel 30 is an improvement over that taught in U.S. Pat. No. 4,066,128. In U.S. Pat. No. 4,066,128, the sleeve valve has seals which engage the wall of the receptacle bore, but the seals of the flow control device and practically all of the gas life valve mechanism are housed within the sleeve valve when a flow control device is present in the mandrel. Thus, the flow control device is quite limited in size. In the case of the present invention, only a small portion of the flow control device telescopes into the sleeve valve—only enough to couple the two together. The flow control device displaces the sleeve valve from its position wherein its seals straddle the lateral ports 42 and then takes the place of the sleeve valve and has its own seals straddling ports 42. The seals of the flow control device and of the sleeve valve all engage the same bore and are equal in size. Thus, there is provided the distinct advantage of having a larger flow control device than was before possible. Thus, standard size flow control devices are used in this apparatus. The larger valve will permit a greater injection rate and result in greater well production rate.

Figure 7:
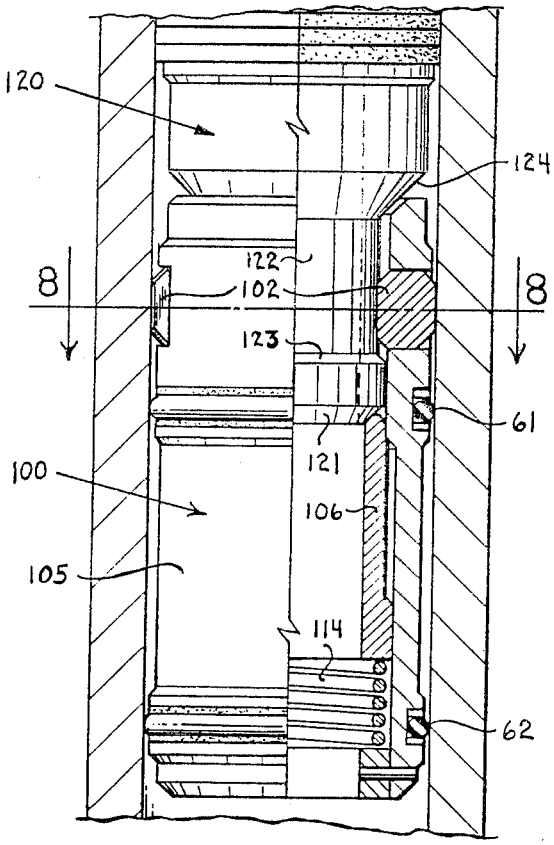
FIG. 7 is a fragmentary view similar to FIG. 6 showing the sleeve valve of FIG. 6 coupled with and held in open position by a flow control device like that shown in FIGS. 3A and 3B.
Figure 8:
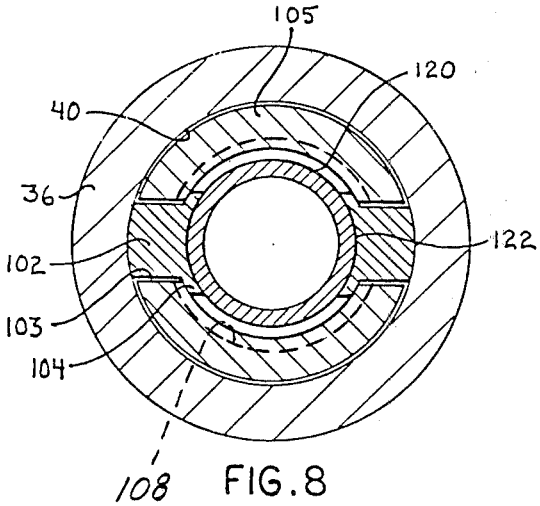
FIG. 8 is a cross-sectional view taken along line 8—8 of FIG. 7.
Figure 6:
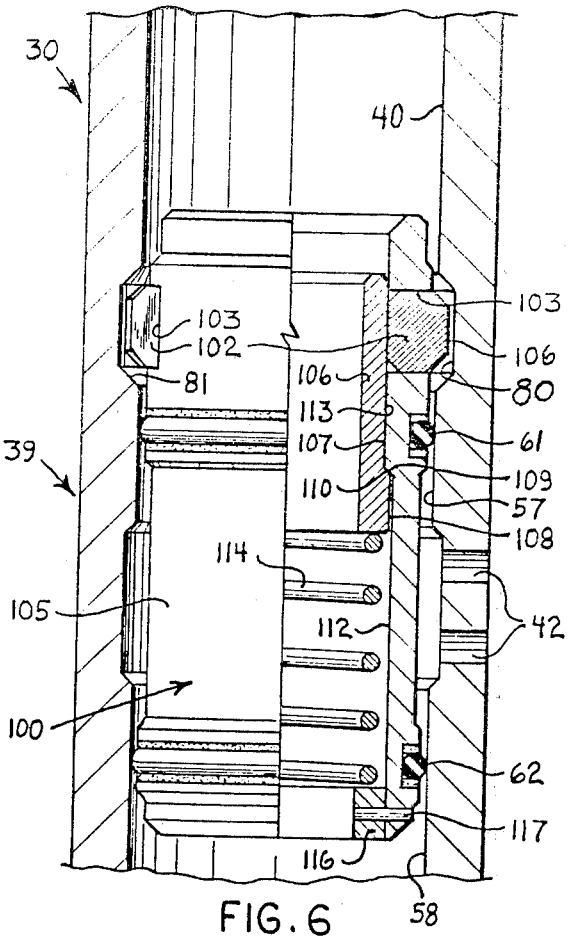
FIG. 6 is a fragmentary view, partly in elevation and partly in section, showing a modified form of sleeve valve in the side pocket receptacle, the sleeve valve being shown in the closed position.

A modified form of the invention is shown in FIGS. 6–8. In this form, the sleeve valve is different from sleeve valve 60 in that it has locking lugs instead of collet fingers with internal and external bosses.

It will be seen in FIG. 6 that the side pocket mandrel 30 has a receptacle 39 having a receptacle bore 40 with ports 42 through the wall thereof and with seal surfaces 57 and 58 above and below ports 42 as in the previous embodiment.

Sleeve valve 100 is disposed in receptacle bore 40 with its seals 61 and 62 sealingly engaged with seal surfaces 57 and 58, respectively, above and below ports 42 to preclude flow therethrough. Sleeve 100 is securely locked in the position shown in FIG. 6 since its pair of locking lugs 102 disposed in windows 103 of body 105 have their outer edges or surfaces 106 engaged in internal recess 80 of the receptacle bore. Sleeve valve 100 is imperforate between its seal rings 61 and 62. Tubular expander 106 is disposed in bore 107 of body 105, and its enlarged lower end 108 provides an upwardly facing shoulder 109 which is engaged with corresponding shoulder 110 provided by the enlarged portion 112 of bore 107 to limit upward movement of expander 106 in the body 105. Thus the expander has its surface 113 between the lugs 102 supporting them against inward movement toward unlocked position. With the lugs 102 thus locked in their expanded position of engagement in internal recess 80, the sleeve valve 100 cannot be moved up or down from the position shown.

Spring 114 is disposed in enlarged bore 112 with its upper end bearing against the lower end surface of expander 106 and with its lower end supported on support ring 116 held in place as shown by one or more suitable pins such as pin 117 disposed in aligned apertures in the ring 116 and the body 105. Thus, the lugs 102 are locked in their expanded position of engagement in internal recess 80, and thus sleeve valve 100 is securely locked in closed position sealing ports 42 and cannot be unintentionally displaced in either longitudinal direction.

However, a suitable flow control device such as the device 120, which may be like the gas lift valve 46, may be installed in the receptacle bore 40 of the mandrel 30 in the same manner that gas lift valve 46 was installed. As the device is moved into the receptacle bore, its lower end portion telescopes into the upper end of the sleeve valve 100, the downwardly facing shoulder 121 thereof contacting the upper end of the expander and depressing it against the compression of spring 114. When the external recess 122 becomes aligned with lugs 102, the lugs are then unlocked and are free to retract from engagement with recess 80. Further downward movement of the device 120 brings downwardly facing shoulder 124 at the upper end of recess 122 into contact with the upper end of sleeve valve body 105, and the device 120 then pushes the sleeve valve 100 down and out of the way and takes its place, the upper and lower seals on the flow control device now sealingly engaging the same internal seal surfaces 57 and 58 of the receptacle bore that were previously sealingly engaged by the seals on the sleeve valve. At no time does a seal of the flow control device engage any part of the sleeve valve.

As the sleeve valve 100 is displaced downwardly from its closed position by the flow control device, the lugs 102 are cammed inwardly by the sloping shoulder 81 which forms the lower wall of recess 80, and the inward portions of the lugs engage external recess 122 of the flow control device. Simultaneously, the lugs enter the confining bore 58 which locks the lugs against outward movement. Thus, the sleeve valve 100 is securely coupled to the flow control device as soon as the lugs 102 enter the bore 58, as clearly shown in FIG. 7.

When the flow control device 120 is withdrawn from the receptacle bore 40, the sleeve valve 100 being coupled thereto as just explained will be lifted, but only until the lugs 102 thereof become aligned with internal recess 80 of the receptacle bore, at which time the inclined shoulder 123 at the lower extent of recess 122 on the flow control device will cam the lugs outwardly into engagement with recess 80, and, therefore, disengage recess 122, thus uncoupling the flow control device from the sleeve valve. Then as the flow control device is withdrawn from its telescoping engagement with the sleeve valve, the lug expander 106 will be forced upwardly by spring 114 to its uppermost position, shown in FIG. 6, wherein it securely locks the lugs 102 in their position of engagement in recess 80 and, thus, securely locks the sleeve valve in its port-closing position as before explained.

As an expedient, and if desired, the sleeve valve body 105 may be formed with an internal annular groove 108 (see FIG. 8) preferably having a width slightly exceeding the height of lugs 102 and aligned with the windows 103, and the lugs 102 can be formed with a wing such as wing 104 on its lateral sides. These wings 104 will then be received in internal groove 108 when the lugs are in expanded position. These wings 104 are not necessary after the sleeve valve has been placed in the receptacle bore 40, but they will be effective to prevent loss of the lugs from the windows during assembly of the sleeve valve and until the sleeve valve is installed in the receptacle bore.

A further embodiment of this invention is illustrated in FIGS. 9A and 9B. Here, it will be seen that modified side pocket mandrel 130 has a receptacle 136 which is similar to receptacle 36 of side pocket mandrel 30, the first embodiment described, but its bore and porting are different from bore 40, and the sleeve valve used therein is different from sleeve valve 60 of the first embodiment.

In FIGS. 9A and 9B, receptacle 136 has a bore 140 having a recess 141 near its upper end providing a downwardly facing lock shoulder 142 and an upwardly facing seating shoulder 143. A communication port 144 is provided through the receptacle wall at a location just above stop shoulder 143 which communicates the bore 140 with the main bore 135 of the mandrel 130.

Below the stop shoulder 143, bore 140 is reduced in diameter and has its inner wall polished, providing upper intermediate and lower seal surfaces 145, 146, and 147, and they are separated by internal annular recesses 148 and 149. At recess 149, a lateral port 150 is provided in the wall of receptacle 136 which fluidly connects receptacle bore 140 with the region exterior mandrel 130.

Below and spaced from lateral port 150 is an upwardly facing stop shoulder 151 provided by a further reduction 152 in bore 140 to limit downward movement of sleeve valve 100, as shown. Drain port 154 is provided in the extreme lower end of bore 152 to allow the receptacle bore to drain into main bore 135 of the mandrel.

A flow control device such as gas lift valve 160 is disposed in the bore 140 of receptacle 136 with lugs 161 of its lock 162 engaged beneath lock shoulder 142. Packing set 164 seals with the bore wall or upper seal surface 145.

Sleeve valve 200 is disposed within receptacle bore 140 and below gas lift valve 160. Sleeve valve 200 is coupled to gas lift valve 160 in the same manner that sleeve valve 60 of the first embodiment (FIGS. 3A and 3B) is coupled to gas lift valve 46. The upstanding collet fingers 202 are telescoped over the reduced lower end portion 204 of the gas lift valve, and the inner bosses 207 of the collet fingers are engaged in the external annular recess 206 of the gas lift valve. The outer bosses 208 of the collet fingers are confined by polished bore 146 to maintain the sleeve valve coupled to the gas lift valve.

The upper seal ring 220 of the sleeve valve 200 seals with seal surface 146 above lateral port 150, and its seal rings 221 and 222 seal below lateral port 150. Seal rings 220, 221, and 222 are spaced from each other as shown in FIG. 3B.

Between seal rings 220 and 221, the sleeve valve 200 is provided with a side port 224 which is shown in direct fluid communication with lateral port 150 when the sleeve valve is in its lower, open position shown. Sleeve valve 200 is imperforate between seals 221 and 222.

Lift gas enters from the annulus or region exterior of the mandrel 130 through lateral port 150 and aligned side port 224 into the bore 226 of the sleeve valve. Bore 226 is closed at its lower end to preclude the uncontrolled flow of lift gas into the lower portion of the receptacle bore 140 and through drain port 154 into the tubing.

Lift gas is directed upwardly in bore 226 of the sleeve valve and upon emerging therefrom enters the lower open end of flow passage 230 of the gas lift valve, unseats check valve 231 and advances therepast. The pressure of the lift gas when sufficient lifts the valve tip 232 from seat 234 against the force of compressed spring 236, and lift gas then flows through seat 234 and passes through outlet ports 238 of the gas lift valve and through communication port 144 onto the tubing. When the pressure of the lift gas reduces to a predetermined value, spring 236 forces valve tip 232 back onseat to stop injection of lift gas into the tubing.

Upon withdrawing gas lift valve 160 from receptacle bore 140, sleeve valve 200 being coupled thereto as before explained is lifted thereby until the outer bosses 208 of the collet fingers 202 become aligned with internal recess 148 at which time the collet fingers inherently spring outwardly to engage the outer bosses of the collet fingers in recess 148 and, at the same time, disengage the inner bosses from external recess 206 of the gas lift valve, thus releasing the gas lift valve from the sleeve valve while locking the sleeve valve in closed position.

When sleeve valve 200 is in port-closing position (not shown) its seal ring 221 seals with the wall of bore 146 of the receptacle above lateral port 150 while its seal ring 222 seals with bore wall 147 below lateral port 150. Thus seals 221 and 222 stradle lateral port 150 and effectively prevent flow therethrough.

It will be noticed that the packing of the gas lift valve 160 does not straddle lateral port 150 when the gas lift valve is in proper position in receptacle bore 140. Lift gas pressure tends to separate the gas lift valve from the sleeve valve, but this cannot happen because upward movement of the gas lift valve is limited by the engagement of the lugs 161 of the lock 162 beneath downwardly facing lock shoulder 142 near the upper end of receptacle bore 140. Downward movement of sleeve valve 200 is limited by engagement of its lower end with upwardly facing shoulder 157 provided by reduced bore 152.

Preferably, the dimensions of the gas lift valve and the sleeve valve should be so related to the dimensions of the receptacle that there will be no tensile load applied to the collet fingers 202 when the gas lift valve and the sleeve valve are coupled together as shown and the pressure of the lift gas is acting thereon.

When a flow control device such as the gas lift valve 160 is installed in the receptacle of side pocket mandrel 130, the lower reduced end portion 204 of the device telescopes into the upstanding collet fingers 202 of the sleeve valve 200 and further downward movement of the device brings its lower end to bear downward upon internal upwardly facing shoulder 240 just inside the base of collet fingers 202, and continued downward movement of the device forces the sleeve valve 200 downwardly. As the sleeve valve 200 moves downwardly, the outer bosses 208 of the collet fingers come into contact with the beveled lower side of internal recess 148 in receptacle bore 145, and the collet fingers are thus cammed inwardly as their outer bosses disengage the recess 148, and their inner bosses become engaged in external recess 206 on the lower end portion of the gas lift valve, thus coupling the sleeve valve 200 to the gas lift valve. When downward movement of the gas lift valve is stopped by engagement of its downwardly facing stop shoulder 250 with upwardly facing stop shoulder 143 of the receptacle, the gas lift valve is then locked in the position shown in FIGS. 9A and 9B by actuating the lock 162 in the well-known manner to engage its lugs 161 beneath lock shoulder 142 of the receptacle. With the gas lift valve thus positioned in the receptacle, lateral port 224 of the sleeve valve 200 is in communication with lateral port 150 of the receptacle, and lift gas can enter the receptacle and advance through the sleeve valve and the gas lift valve and into the tubing as before explained.

Thus it has been shown that a new and improved side pocket mandrel has been provided having a sleeve valve in the offset receptacle bore thereof which closes the lateral ports against flow of fluids therethrough whenever no flow control device is disposed in its receptacle bore; that when a flow control device is installed in its offset receptacle bore, the flow control device displaces the sleeve valve from its port-closing position to its port-opening position; that as soon as the sleeve valve is moved by the flow control device from its port-closing position, it becomes securely coupled to the flow control device; that when the flow control device is then withdrawn from the receptacle bore it lifts the sleeve valve back to its port-closing position; that when the sleeve valve reaches its port-closing position it automatically becomes decoupled from the flow control device which can then be withdrawn fully from the receptacle without it; that when the sleeve valve is thus returned to its port-closing position it becomes automatically latched in that position; that in at least one form of the invention the sleeve valve is securely locked in port-closing position against longitudinal displacement therefrom in either longitudinal direction, but can be readily displaced to port-opening position by a proper flow control device; and that in each form of the invention both the seals of the sleeve valve and the flow control device sealingly engage the inner wall of the receptacle bore and are thus of equal diameter, permitting use of standard flow control devices having standard size flow passages therethrough.

While only the preferred embodiments of the invention have been illustrated and described hereinabove, it should be understood by those skilled in the art that changes and modifications may come to mind and be resorted to without departing from the true spirit of the invention, the scope of which is defined by the claims which are appended hereto.

What is claimed is:

1. A well device for controlling flow between the interior and the exterior of a well flow conductor, comprising:

a. a mandrel having a main bore therethrough, a belly offset from said main bore and having a receptacle bore therein for receiving a flow control device, said receptacle bore having lateral port means through the wall thereof communicating the receptacle bore with the exterior of the mandrel, said mandrel being connectable in said well flow conductor with its main bore in axial alignment therewith;

b. seal surface means in said receptacle bore providing spaced annular seal surfaces, one on either side of said lateral port means engageable with said flow control device;

c. sleeve valve means in said receptacle bore slidably movable therein between port-closing and port-opening positions for controlling flow through said lateral port means, said sleeve valve means having spaced seal means thereon engaging said spaced annular seal surfaces in said receptacle bore to block flow through said port means when said sleeve valve means is in port-closing position, said sleeve valve means being movable to port-opening position automatically upon installation of said flow control device in said receptacle bore, said flow control device having spaced seal means thereon engageable with said spaced seal surfaces when said flow control device is in position in said receptacle bore; and d. means on said sleeve valve means coengageable with means on said flow control device to couple said flow control device to said sleeve valve means upon installation thereof and for moving said sleeve valve means to port-closing position responsive to removal of said flow control device from said receptacle bore.

2. The device of claim 1, including coengageable means on said sleeve valve means and means in said receptacle bore for latching said sleeve valve means in said port-closing position.

3. The device of claim 2, wherein said coengageable means for latching said sleeve valve means in said port-closing position comprises:

a. internal recess means formed in the inner wall of said receptacle bore; and b. latch members carried on said sleeve valve means and having external bosses thereon engageable in said internal recess.

4. The device of claim 3, wherein said means for moving said sleeve valve means between port-closing and port-opening position includes:

a. upwardly facing shoulder means on said sleeve valve means engageable by downwardly facing shoulder means on said flow control device to move said sleeve valve means from said port-closing to said port-opening position responsive to installation of said flow control device in said receptacle bore; and b. inner bosses on said latch members engageable in external recess means on said flow control device to couple said sleeve valve means to said flow control device as said sleeve valve means is displaced from said port-closing position, said latch members being releasable from engagement in said recess to uncouple said flow control device when said sleeve valve means is returned to said port-closing position responsive to removal of said flow control device from said receptacle bore.

5. A well device for controlling flow between the interior and the exterior of a well flow conductor, comprising:

a. a mandrel having a main bore therethrough, a belly offset from said main bore and having a receptacle bore therein for receiving a flow control device, said receptacle bore having lateral port means through the wall thereof communicating the receptacle bore with the exterior of the mandrel, said mandrel being connectable in said well flow conductor with its main bore in axial alignment therewith;

b. seal surface means in said receptacle bore providing spaced annular seal surfaces, one on either side of said lateral port means engageable with said flow control device;

c. sleeve valve means in said receptacle bore slidably movable therein between port-closing and port-opening positions for controlling flow through said lateral port means, said sleeve valve means having spaced seal means thereon engaging said spaced annular seal surfaces in said receptacle bore to block flow through said port means when said sleeve valve means is in port-closing position, said sleeve valve means being movable to port-opening position automatically upon installation of a flow control device in said receptacle bore, said flow control device having spaced seal means thereon engageable with said spaced seal surfaces when said flow control device is in position in said receptacle bore;

d. internal latching recess means in said receptacle bore; and e. collet fingers on said sleeve valve means, including:

i. external bosses on said collet fingers engageable in said internal latching recess means to latch said sleeve valve means in port-closing position, and ii. internal bosses on said collet fingers engageable in corresponding external recess means on said flow control device to couple said sleeve valve means to said flow control device when said sleeve valve means is moved from said port-closing position and said external collet finger bosses disengage said internal latching recess means in said receptacle bore, said internal collet finger bosses disengaging said external recess to release said flow control device responsive to movement of said sleeve valve means back to said port-closing position and said external collet finger bosses re-engage said internal latching recess means in said receptacle bore.

6. The device of claim 5, further including:

a. upwardly facing shoulder means on said sleeve valve means engageable by downwardly facing shoulder means on said flow control device to move said sleeve valve means from said port-closing to port-opening position upon installation of said flow control device in said receptacle bore.

7. The device of claim 5 or 6, including:

a. a lock recess in said receptacle bore; and b. a flow control device disposed in said receptacle bore for controlling flow through said lateral port means, said flow control device including:

i. a housing;

ii. lock means on said housing engaged in said lock recess in said receptacle bore;

iii. flow control means in said housing;

iv. spaced seal means sealingly engaging said spaced seal surfaces of said receptacle bore on either side of said lateral port means to direct all fluids flowing through said lateral port means through said flow control means;

v. downwardly facing shoulder means on said housing engageable with said sleeve valve means to move said sleeve valve means from port-closing to port-opening position upon installation of said flow control device in said receptacle bore; and vi. external recess means on said housing engaged with said means on said sleeve valve means latching said sleeve valve means to said flow control device.

8. The device of claim 7, wherein said flow control device is a gas lift valve.

9. A well device for controlling flow between the interior and the exterior of a well flow conductor, comprising:

a. a mandrel having a main bore therethrough, a belly offset from said main bore and having a receptacle bore therein for receiving a flow control device, said receptacle bore having lateral port means through the wall thereof communicating the receptacle bore with the exterior of the mandrel, said mandrel being connectable in said well flow conductor with its main bore in axial alignment therewith;

b. spaced annular seal surface means in said receptacle bore on either side of said lateral port means engageable with said flow control device;

c. sleeve valve means in said receptacle bore slidably movable therein between port-closing and port-opening positions for controlling flow through said lateral port means, said sleeve valve means having spaced seal means thereon engaging said spaced annular seal surfaces in said receptacle bore to block flow through said port means when said sleeve valve means is in port-closing position, said sleeve valve means being movable to port-opening position automatically upon installation of a flow control device in said receptacle bore, said flow control device having spaced seal means thereon engageable with said spaced seal surfaces when said device is in position in said receptacle bore;

d. internal latching recess means in said receptacle bore;

e. latching lugs mounted in windows in said sleeve valve means for expansible and retractable movement therein, said latching lugs including:

i. external latching surfaces on said lugs engageable in said internal latching recess means of said receptacle bore to latch said sleeve valve means in said port-closing position, and ii. internal coupling surfaces on said lugs engageable in corresponding external recess means on said flow control device to couple said sleeve valve means to said flow control device when said sleeve valve means is moved from said port-closing position and said external latching surfaces on said lugs disengage said internal latching recess means in said receptacle bore, said internal coupling surfaces of said lugs disengaging said external recess means to release said flow control device responsive to movement of said sleeve valve means back to said port-closing position and said external latching surfaces on said lugs re-engage said internal latching recess in said receptacle bore; and f. upwardly facing shoulder means on said sleeve valve means engageable by downwardly facing shoulder means on said flow control device to move said sleeve valve means from said port-closing to port-opening position upon installation of said flow control device in said receptacle bore.

10. The device of claim 9, further including:

expander means in said sleeve valve means locking said lugs in expanded position and being slidable to lug unlocking position upon installation of said flow control device in said receptacle bore.

11. The device of claim 10, further including:

biasing means carried by said sleeve valve means for biasing said expander means toward lug-expanding position.

12. The device of claim 11, wherein said biasing means is a coil spring.

13. The device of claim 9, 10, 11, or 12, including:

a. a lock recess in said receptacle bore; and b. a flow control device disposed in said receptacle bore for controlling flow through said lateral port means, said flow control device including:

i. a housing;

ii. lock means on said housing engaged in said lock recess in said receptacle bore;

iii. flow control means in said housing;

iv. spaced seal means sealingly engaging said spaced seal surfaces of said receptacle bore on either side of said lateral port means to direct all fluids flowing through said lateral port means through said flow control means;

v. downwardly facing shoulder means on said housing engageable with said sleeve valve means to move said sleeve valve means from port-closing to port-opening position upon installation of said flow control device in said receptacle bore; and vi. external recess means on said housing engaged with said means on said sleeve valve means latching said sleeve valve means to said flow control device.

14. The device of claim 13, wherein said flow control device is a gas lift valve.

15. A well device for controlling flow between the interior and the exterior of a well flow conductor, comprising:

a. a mandrel having a main bore therethrough, a belly offset from said main bore and having a receptacle bore therein for receiving a flow control device, said receptacle bore having lateral port means through the wall thereof communicating the receptacle bore with the exterior of the mandrel, said mandrel being connectable in said well flow conductor with its main bore in axial alignment therewith;

b. spaced annular seal surface means in said receptacle bore on either side of said lateral port means engageable with said flow control device;

c. sleeve valve means in said receptacle bore slidably movable therein between port-closing and port-opening positions for controlling flow through said lateral port means, said sleeve valve means having first, second, and third seal means thereon, and having aperture means through the wall thereof between said second and third seal means, said first and second seal means engaging said spaced seal surfaces of said receptacle bore to seal above and below said lateral port means when said sleeve valve means is in port-closing position and said second and third seal means engaging said seal surfaces above and below said lateral port means with said lateral aperture aligned with said lateral port means when said sleeve valve means is in port-opening position, said sleeve valve being movable to port-opening position automatically upon installation of a flow control device in said receptacle bore;

d. internal latching recess means in said receptacle bore; and e. collet fingers on said sleeve valve means having external bosses thereon engageable in said internal latching recess means to latch said sleeve valve means in port-closing position.

16. The device of claim 15, further including:

a. upwardly facing shoulder means on said sleeve valve means engageable by downwardly facing shoulder means on said flow control device to move said sleeve valve means from said port-closing position upon installation of said flow control device in said receptacle bore; and b. inwardly projecting bosses on said collet fingers engageable in external recess means on said flow control device when said sleeve valve means is moved from said port-closing position and said external collet finger bosses disengage said internal recess in said receptacle bore, said inwardly projecting bosses disengaging said external recess to release said flow control device responsive to movement of said sleeve valve means back to said port-closing position and said external collet finger bosses move outwardly into engagement with said internal recess in said receptacle bore.

17. The device of claim 15 or 16, including:

a. a lock recess in said receptacle bore; and b. a flow control device disposed in said receptacle bore for controlling flow through said lateral port means, said flow control device including:

i. a housing;

ii. lock means on said housing engaged in said lock recess in said receptacle bore;

iii. flow control means in said housing;

iv. spaced seal means sealingly engaging the wall of said receptacle bore on either side of said lateral port means to direct all flow from said lateral port means through said flow control means;

v. downwardly facing shoulder means on said housing engageable with said sleeve valve means to move said sleeve valve means from port-closing to port-opening position upon installation of said flow control device in said receptacle bore; and vi. external recess means on said housing engaged with said means on said sleeve valve means latching said sleeve valve means to said flow control device.

18. The device of claim 17, wherein said flow control device is a gas lift valve.

* * * * *